US005520614A

United States Patent [19]

McNamara et al.

[11] Patent Number: 5,520,614

[45] Date of Patent: May 28, 1996

[54] VESTIBULAR MOTION TABLE

[75] Inventors: Jack McNamara, Phoenix; Mark W. Thomas, Scottsdale, both of Ariz.

[73] Assignee: RedBarn Enterprises, Inc., Phoenix, Ariz.

[21] Appl. No.: 365,341

[22] Filed: Dec. 28, 1994

[51] Int. Cl.[6] ..... A61H 1/00

[52] U.S. Cl. ..... 601/24; 601/26; 601/98

[58] Field of Search ..... 601/5, 6, 23, 24, 601/26, 51, 53, 85, 89, 90, 93, 98, 101, 134; 606/242; 5/622, 623, 636, 646; 602/32, 33, 36; 297/344.17, 344.27; 108/20, 21, 139

[56] References Cited

U.S. PATENT DOCUMENTS

| | | | |
|---|---|---|---|
| 2,243,013 | 5/1941 | Morey et al. | 601/101 |
| 2,941,526 | 6/1960 | Mott | 601/26 |
| 3,043,293 | 7/1962 | Rider | 601/86 |
| 3,585,989 | 6/1971 | Little | 601/26 |
| 4,483,327 | 11/1984 | Graham et al. | 601/26 |
| 4,546,764 | 10/1985 | Gerber | 601/53 |
| 4,586,492 | 5/1986 | Manahan | 601/90 |
| 4,723,537 | 2/1988 | Parker, Jr. | 601/26 |
| 5,301,661 | 4/1994 | Lloyd | 601/101 |

*Primary Examiner*—Richard J. Apley
*Assistant Examiner*—Jeanne M. Clark
*Attorney, Agent, or Firm*—Frank J. McGue

[57] ABSTRACT

A vestibular motion table is disclosed for providing a reciprocating, horizontal motion to a user. The table comprises a base and a table top suitable for the user to lie upon. A plurality of support legs is pivotally connected to the base at one of end and is pivotally connected to the table top at the other end. The table includes an electric gear motor having an eccentric mounted thereon. A power transmission shaft is connected at one end to the eccentric while the other end is connected to the table top. A controller in electrical communication with the gear motor and a source of electrical power controls the speed of the motion.

6 Claims, 2 Drawing Sheets

FIG. 1
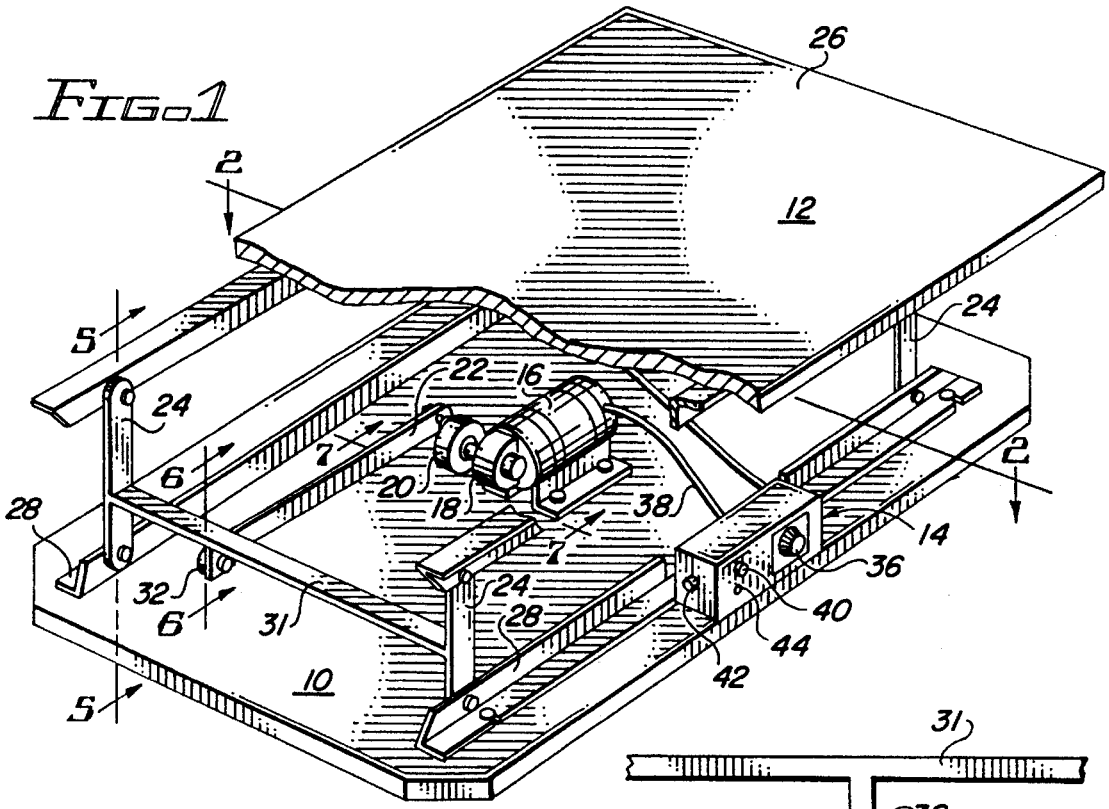
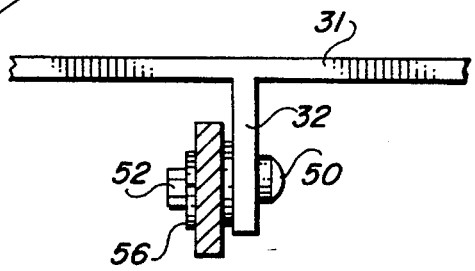
FIG. 6
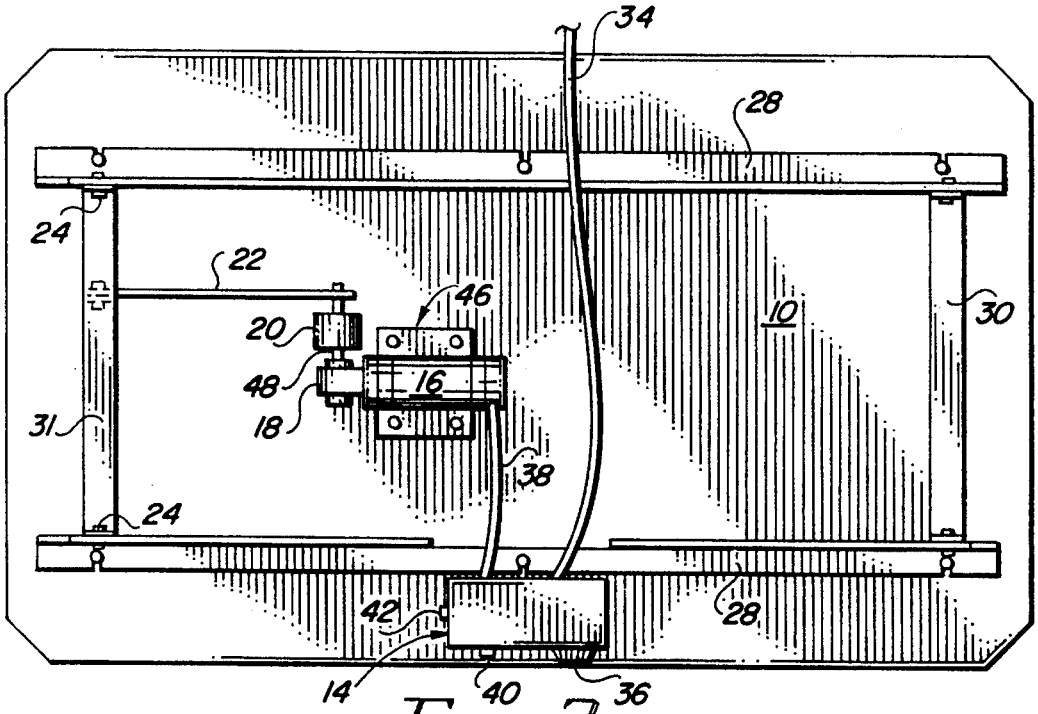
FIG. 2

VESTIBULAR MOTION TABLE

TECHNICAL FIELD

This invention relates to a medical device for providing rhythmic motion and more particularly for providing a gliding vestibular motion for therapeutic use.

BACKGROUND OF THE INVENTION

The vestibular system is the sensory system that responds to the position of the head in relation to vestibular motion, specifically, gravity and accelerated or decelerated motion. The vestibular system is found in the cerebellar area of the brain and influences righting reactions, muscle tone, standing balance, ocular orientation, visual perception, general arousal/attention, and neck and head orientation. Brain damage to individuals may interfere with the organization of the central nervous system, and, in particular, the vestibular system. Vestibular damage can be found in a number of disorders, including, but not limited to, developmental delay of unknown origin, cerebral palsy, traumatic brain injury, autism, attention deficit disorder, stroke, blindness and hearing impairment. These neurological problems can occur in both the pediatric and adult populations.

Research has shown many benefits from vestibular motion therapy including decreased self stimulation, decreased hypersensitivity, increased postural security, increased concentration and attentiveness, increased balance, increased body awareness, calming effects, reduction of abnormal muscle tone at slow speeds and increased alertness at high speeds.

DESCRIPTION OF THE PRIOR ART

Heretofore a number of devices have been directed to providing therapy via vestibular motion. All of these devices combine a horizontal motion with a rounding motion.

For example, a non-motorized linear glider requires the patient to start from a stationary position. The patient uses the handles and shifts his or her weight to move the glider in a reciprocal motion. However, this device requires that the patient have sufficient motor control to actually perform the needed movements.

Still another patient activated non-motorized device is a water filled flotation mattress. The mattress provides a oscillating motion in response to patient movement. Of course, the mattress is very heavy with the possibility of a messy spill in the event of leakage. In addition, this device requires the patient to actually perform the needed motions.

Another non-motorized device is a platform swing in which movement is handled by the therapist. This device provides a wide range of tilting motions as well as horizontal movement. All of the non-motorized equipment presently available requires an individual, either the patient or a therapist, to generate the motion. Thus, such equipment cannot be employed for lengthy periods of time without fatigue.

Motorized equipment such as the Integrated Motion System manufactured by Integrative Motion Systems, Inc. of Ventura, Calif. provide a pulsating wave-like massage via constant vibration.

The known prior art is described above. None of the known prior art disclose the device set forth herein.

SUMMARY OF THE INVENTION

It is an object of this invention to provide a device for horizontal gliding vestibular motion.

It is a further object of this invention to provide a variable speed device for vestibular motion.

It is a further object of this invention to provide vestibular motion for long periods of time under controlled circumstances.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawings in which:

FIG. 1 is a perspective cut-away view of the present invention;

FIG. 2 is a cross sectional view of FIG. 1 taken along the line 2—2;

FIG. 6 is a cross sectional view of FIG. 1 taken along the line 6—6.

BRIEF DESCRIPTION OF THE PREFERRED EMBODIMENT

Figure 3:
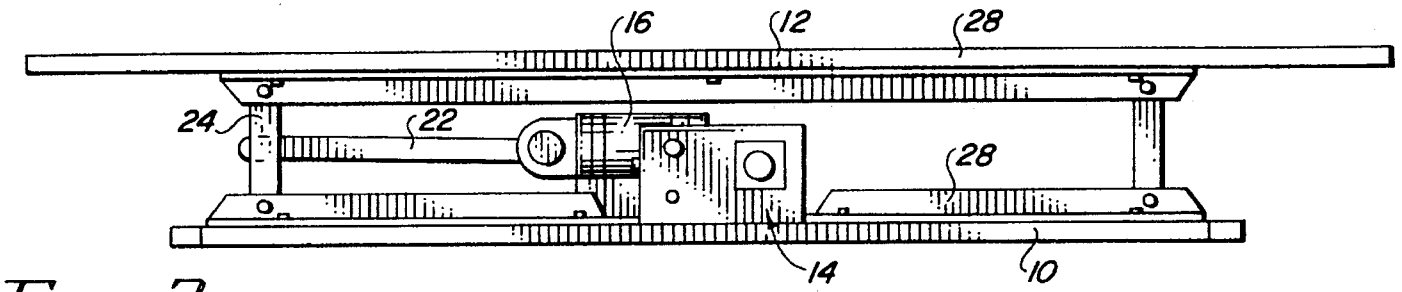
FIG. 3 is a side view of the present invention.

Referring more particularly to the drawings by characters of reference, FIGS. 1–7 depict a vestibular motion table having a base 10, a table top 12, a control device 14, a motor 16, a gear 18, an eccentric 20, a power transmission shaft 22 and support legs 24. The table top 12 and the base 10 are preferably rectangular in shape and composed of ¾ inch plywood, with the top 26 of the table top 12 being suitable for a user to lie comfortably upon. In one embodiment, a soft carpet or vinyl is tacked onto the top 26 to provide a suitable surface. Of course, many other suitable surfaces are available. Suitable table tops 12 and bases 10 may be purchased at most building supply stores such as Home Depot.

In the presently preferred embodiment, the table top 12 is 54 inches long by 24 inches wide. The base 10 is the same width but the base length is 42 inches. As an alternate embodiment, a floor could be used as the base 10, however, this alternate embodiment would not be as portable as the preferred version.

Figure 5:
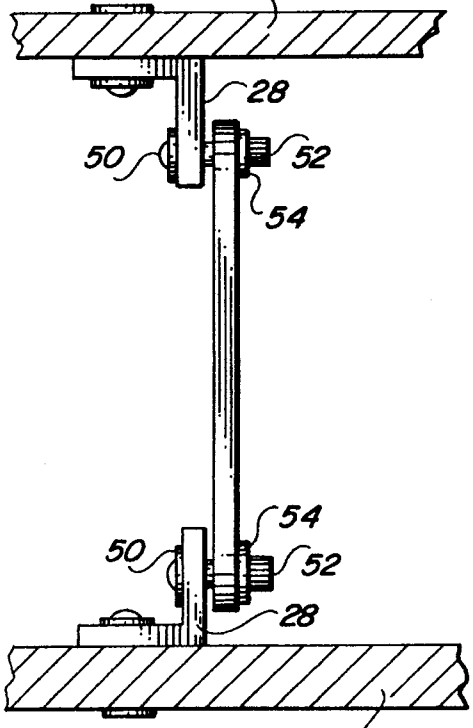
FIG. 5 is a cross sectional view of FIG. 1 taken along the line 5—5.

As best seen in FIG. 2, in the preferred embodiment, two opposing angle pieces 28 are bolted to the base 10 and extend longitudinally proximate to each long side of the base 10. As best seen in FIG. 3 and 5, two support legs 24 are pivotally connected to each of the angle pieces 28 proximate to the corners of the base 10. In the preferred embodiment, four jamb nuts 50 in combination with four shoulder bolts 52 and four bushings 54 pivotally connect the angle pieces 28 and the support legs 24.

Two corresponding angle pieces 28 are bolted to the underside of the table top 12 and extend longitudinally proximate to the long side of the top. Four jamb nuts 50 in combination with four shoulder bolts 52 and four bushings 54 pivotally connect the support legs 24 corresponding to the angle pieces 28 mounted to the underside of the table top 12.

To provide additional structural stability, two cross pieces 30, 31 connect each opposing support leg 24 laterally. As further discussed, cross piece 31 is preferably T-shaped whereby the leg 32 of the T extends downwardly as shown in FIGS. 4 and 6.

Figure 4:
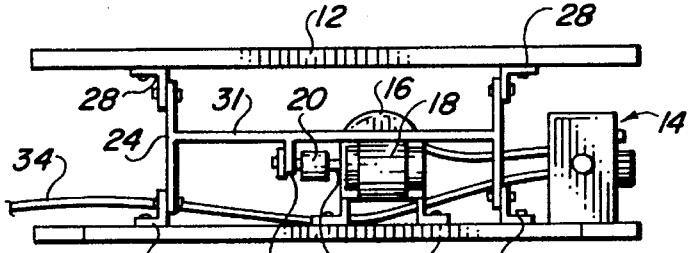
FIG. 4 is a front view of present invention.
Figure 7:
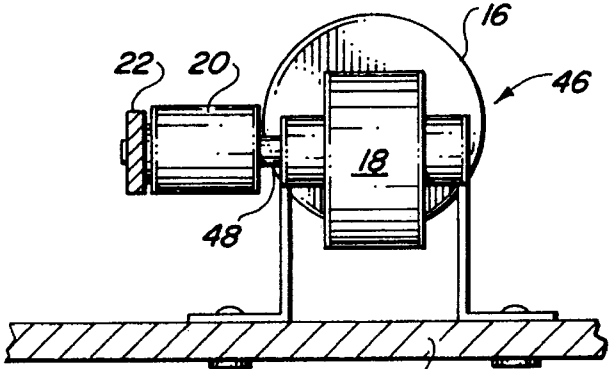
FIG. 7 is a cross sectional view of FIG. 1 taken along the line 7—7.

As shown in FIGS. 3 and 4, the support legs 24 when fully upright will position the table top 12 at preferably about 7¼ inches above the floor. The short height is preferred as many of the patients may have difficulty mounting a higher table. However, the height can be altered as desired.

As illustrated in FIGS. 1, 2, 4 and 7, mounted on the base 10 are a control device 14, a gear motor 46 and the eccentric 20. The control device 14 includes an electrical inlet cord 34 for plugging into a suitable receptacle. A controller 36 allows the user to vary the electrical power transmitted via a power outlet cord 38 to the motor 16 and thus control the speed of the motor 16. An LED 40 provides an on/off indicator while a fuse 42 provides circuit protection in the event of an electrical power surge. A jack 44 such as Model No. PK-3 available from Radio Shack can be provided as an interface for remote control of the table such as a foot pedal (not shown).

Preferably, the gear motor 46 comprising the motor 16 and the gear 18 in combination is also mounted on the base 10 such that the motor shaft 48 is laterally oriented. Mounted on shaft 48 is the eccentric 20 which converts the rotary motion of the gear motor shaft 48 into a reciprocating motion. The eccentric 20 is connected to one end of the power transmission shaft 22 whose opposing end is connected to the leg 32 of the T-shaped cross piece 31. As shown in FIG. 6, the connection to the leg 32 of the T-shaped cross piece 31 is accomplished via the same shoulder bolt 52 and jamb nut 50 combination described previously in connecting the support legs 24 to the angle pieces 28 except for the employment of a bearing 56 between the shoulder bolt and the power transmission shaft 22 instead of the bushing described previously.

Thus, when the gear motor is running, its rotational motion is transmitted to the eccentric 20 which thereby converts the motion into a reciprocating longitudinal motion. The reciprocating motion is transmitted via the power transmission shaft 22 which connects the eccentric 20 and the T-shaped cross piece to the table top 12. The table top 12 will provide a reciprocating longitudinal motion to provide vestibular motion to the patient lying upon the table top 12.

It should be apparent that the reciprocating horizontal motion can be transmitted to the table top 12 via other methods. For example, the shaft 22 could be bolted directly to the table top 12, or perhaps to one of the support legs 24.

In the preferred embodiment, the table top 12 moves longitudinally about ½ inch in each cycle. Also preferably, the device provides a reciprocating frequency of between 0–200 cycles per minute where the actual frequency employed is determined by the settings on the controller 36.

The cycling speed of the table is varied by the controller and the table will reciprocate until the user, via the controller, turns off the motor 16. The controller 36 also allows the user to easily duplicate speeds used previously.

The components of the above invention are readily available from retail sources in most cities. To be specific, the metal pieces described above including the angle pieces 28, the support legs 24, the cross pieces 30, 31 and the power transmission shaft 22 are available from Glendale Steel Supply of Glendale, Ariz. The nuts 50 and bolts 54 utilized can be obtained from Copper State Bolt & Nut. The bushings 54 and bearing 56 are products of Kaman Industrial Technologies Corporation. The gear motor 46 and its controller 36 can be obtained from Minarik Electric Company. A suitable eccentric 20 can be purchased from Precision Short Run, Inc. The latter four companies are located in Phoenix, Ariz.

Although but one embodiment has been illustrated and described, it will be apparent to those skilled in the art that various changes and modifications may be made therein without departing from the spirit of the invention or from the scope of the appended claims.

What is claimed is:

1. A vestibular motion table for providing a reciprocating, horizontal motion to a user, the table comprising:

a base;

a table top suitable for the user to lie upon the table top and the base being two rectangles having the same orientation;

four support legs having two ends, each of the support legs being pivotally connected and mounted proximate to each of the corners of the base at one of the ends and being pivotally connected to the corresponding corners of the table top at the other of the ends;

two cross pieces, each cross piece connecting two support legs, the connected support legs being laterally opposing;

a gear motor;

an eccentric connected to the gear motor;

a power transmission shaft having two ends, one end being connected to the eccentric and the other end connected to one of the cross pieces whereby the cross piece transmits the motion of the power transmission shaft to the support legs and to the table top;

means for controlling the speed of the moving means.

2. The table as set forth in claim 1 wherein the motor is electrically driven.

3. The table as set forth in claim 2 wherein the means for controlling the speed comprises a controller in electrical communication with the gear motor and a source of electrical power.

4. The table as set forth in claim 1 wherein the table top surface is a carpet.

5. The table as set forth in claim 1 wherein the table top surface is vinyl.

6. The table as set forth in claim 1 further comprising four angle pieces, two each being mounted longitudinally on the base and the table top, the support legs being mounted to the angle pieces.

* * * * *